US008187345B2

(12) United States Patent
Eisenbeis et al.

(10) Patent No.: US 8,187,345 B2
(45) Date of Patent: May 29, 2012

(54) MIXTURE FROM POLAR OIL-SOLUBLE NITROGEN COMPOUNDS AND ACID AMIDES AS PARAFFIN DISPERSANT FOR FUELS

(75) Inventors: Ansgar Eisenbeis, Weisenheim am Berg (DE); Irene Troetsch-Schaller, Bissersheim (DE); Ulrich Annen, Hassloch (DE)

(73) Assignee: BASF SE, Ludwigshafen (DE)

( * ) Notice: Subject to any disclaimer, the term of this patent is extended or adjusted under 35 U.S.C. 154(b) by 545 days.

(21) Appl. No.: 12/305,386

(22) PCT Filed: Jun. 12, 2007

(86) PCT No.: PCT/EP2007/055760

§ 371 (c)(1),
(2), (4) Date: Dec. 18, 2008

(87) PCT Pub. No.: WO2007/147753

PCT Pub. Date: Dec. 27, 2007

(65) Prior Publication Data

US 2009/0188159 A1 Jul. 30, 2009

(30) Foreign Application Priority Data

Jun. 22, 2006 (EP) ..... 06115866

(51) Int. Cl.
*C10L 1/22* (2006.01)
*C10L 1/18* (2006.01)

(52) U.S. Cl. ..... 44/399; 44/347; 44/388; 44/403; 44/408; 44/418; 44/419

(58) Field of Classification Search ..... 44/347, 44/399, 351, 408, 418, 419
See application file for complete search history.

(56) References Cited

U.S. PATENT DOCUMENTS

| | | | | |
|---|---|---|---|---|
| 4,242,101 | A * | 12/1980 | Vogel et al. | 44/335 |
| 5,743,923 | A | 4/1998 | Davies et al. | |
| 6,786,940 | B1 * | 9/2004 | Wenderoth et al. | 44/399 |
| 2003/0163948 | A1 * | 9/2003 | Van Leest et al. | 44/347 |
| 2005/0113266 | A1 | 5/2005 | Krull et al. | |
| 2007/0149417 | A1 | 6/2007 | Krull et al. | |

FOREIGN PATENT DOCUMENTS

| | | | |
|---|---|---|---|
| DE | 57557 | | 12/1980 |
| EP | 0 055 355 | A1 | 7/1982 |
| EP | 1 526 167 | A2 | 4/2005 |
| EP | 1 801 187 | A2 | 6/2007 |
| GB | 842 991 | | 8/1960 |
| GB | 1410788 | | 10/1975 |
| GB | 1410788 | A * | 10/1975 |
| WO | WO 94/10267 | | 5/1994 |
| WO | WO 00/23541 | | 4/2000 |

OTHER PUBLICATIONS

U.S. Appl. No. 12/482,059, filed Jun. 10, 2009, Maehling, et al.

* cited by examiner

*Primary Examiner* — Ellen McAvoy
*Assistant Examiner* — Latosha Hines
(74) *Attorney, Agent, or Firm* — Oblon, Spivak, McClelland, Maier & Neustadt, L.L.P.

(57) ABSTRACT

Provided is a mixture containing: (a) a polar oil-soluble nitrogen compounds which is capable of sufficiently dispersing paraffin crystals precipitated out under cold conditions in a fuel and is a reaction product formed from reacting a poly($C_2$- to $C_{20}$-carboxylic acid), which has at least one tertiary amino group, with a primary or secondary amine; (b) an oil-soluble acid amide reaction product formed from reacting a polyamide, which has from 2 to 1000 carbon atoms, with a $C_8$- to $C_{30}$-fatty acid or fatty acid-like compound, which has a free carboxyl group; and (c) an oil-soluble reaction product formed from reacting an α,β-dicarboxylic acid, which has from 4 to 300 carbon atoms, or a derivatives thereof, with a primary alkylamine, wherein the sum of components (a) to (c) constitute 100 wt. % of the mixture. The mixture is suitable as a paraffin dispersant in fuels, especially those having a biodiesel content.

20 Claims, No Drawings

MIXTURE FROM POLAR OIL-SOLUBLE NITROGEN COMPOUNDS AND ACID AMIDES AS PARAFFIN DISPERSANT FOR FUELS

The present invention relates to a mixture comprising (a) from 5 to 95% by weight of at least one polar oil-soluble nitrogen compound other than components (b) and (c) which is capable of sufficiently dispersing paraffin crystals precipitated out under cold conditions in fuels, (b) from 1 to 50% by weight of at least one oil-soluble acid amide formed from polyamines having from 2 to 1000 carbon atoms and $C_8$- to $C_{30}$-fatty acids or fatty acid-like compounds comprising free carboxyl groups and (c) from 0 to 50% by weight of at least one oil-soluble reaction product formed from α,β-dicarboxylic acids having 4 to 300 carbon atoms or derivatives thereof and primary alkylamines, the sum of all components of the mixture (a) to (c) adding up to 100% by weight.

The present invention further relates to the use of this mixture as an additive to fuels, especially in the function as a paraffin dispersant, to such fuels themselves and to fuel additive concentrates which comprise this mixture dissolved in a hydrocarbon solvent. The fuels mentioned have in particular a biodiesel content.

Middle distillate fuels of fossil origin, especially gas oils, diesel oils or light heating oils, which are obtained from mineral oil, have different contents depending on the origin of the crude oil. At low temperatures, there is deposition of solid paraffins at the cloud point ("CP"). In the course of further cooling, the platelet-shaped n-paraffin crystals form a kind of "house of cards structure" and the middle distillate fuel ceases to flow even though its predominant portion is still liquid. The precipitated n-paraffins in the temperature range between cloud point and pour point considerably impair the flowability of the middle distillate fuels; the paraffins block filters and cause irregular or completely interrupted fuel supply to the combustion units. Similar disruptions occur in the case of light heating oils.

It has long been known that suitable additives can modify the crystal growth of the n-paraffins in middle distillate fuels. Very effective additives prevent middle distillate fuels from becoming solid even at temperatures a few degrees Celsius below the temperature at which the first paraffin crystals crystallize out. Instead, fine, readily crystallizing, separate paraffin crystals are formed, which pass through filters in motor vehicles and heating systems, or at least form a filter-cake which is permeable to the liquid portion of the middle distillates, so that disruption-free operation is ensured. The effectiveness of the flow improvers is expressed, in accordance with European standard EN 116, indirectly by measuring the cold filter plugging point ("CFPP").

Ethylene-vinyl carboxylate copolymers have been used for some time as cold flow improvers or middle distillate flow improvers ("MDFI"). One disadvantage of these additives is that the precipitated paraffin crystals, owing to their higher density compared to the liquid portion, tend to settle out more and more at the bottom of the vessel in the course of storage. As a result, a homogeneous low-paraffin phase forms in the upper part of the vessel and a biphasic paraffin-rich layer at the bottom. Since the fuel is usually drawn off just above the vessel bottom both in fuel tanks and in storage or supply tanks of mineral oil dealers, there is the risk that the high concentration of solid paraffins leads to blockages of filters and metering devices. The further the storage temperature is below the precipitation temperature of the paraffins, the greater this risk becomes, since the amount of paraffin precipitated increases with falling temperature. In particular, fractions of biodiesel also enhance this undesired tendency of the middle distillate fuel to paraffin sedimentation.

By virtue of the additional use of paraffin dispersants or wax antisettling additives ("WASA"), these problems can be reduced.

In view of decreasing world mineral oil reserves and the discussion about the environmentally damaging consequences of the consumption of fossil and mineral fuels, interest is rising in alternative energy sources based on renewable raw materials. These include in particular native oils and fats of vegetable or animal origin. These are in particular triglycerides of fatty acids having from 10 to 24 carbon atoms which are converted to lower alkyl esters such as methyl esters. These esters are generally also referred to as "FAME" (fatty acid methyl ester).

Mixtures of these FAMEs with middle distillates have poorer cold performance than these middle distillates alone. In particular, the addition of the FAMEs increases the tendency to form paraffin sediments.

WO 00/23541 (1) describes the use of a mixture of from 5 to 95% by weight of at least one reaction product of a poly ($C_2$- to $C_{20}$-carboxylic acid) having at least one tertiary amino group with secondary amines and from 5 to 95% by weight of at least one reaction product formed from maleic anhydride and a primary alkylamine as an additive for mineral oil middle distillates, especially as a paraffin dispersant and lubricity additive.

EP-A 055 355 (2) discloses that an oil-soluble acid amide of a polyamine with a fatty acid having at least 8 carbon atoms or a fatty acid-like compound comprising free hydroxyl groups also brings about improved cold performance of a mineral oil distillate. A combination of such acid amides with further additives which improve the cold performance of mineral oil distillates is not described in (2).

WO 94/10267 (3) describes flow improvers and paraffin dispersants, for example comb polymers, for mixtures of fuel oils of vegetable origin and fuel oils based on mineral oil.

It was an object of the invention to provide products which ensure improved flow performance of fuels, especially in the case of those fuels which have a content of biofuel oil (biodiesel) which is based on fatty acid esters, at low temperature, by virtue of them exhibiting such dispersant action that settling out of precipitated paraffins is retarded or prevented.

According to the invention, the object is achieved by the mixture of components (a) to (c) mentioned at the outset, which is all the more astonishing in that components (a) and (b) alone each have only a slight, insufficient flow-improving effect, if any, in a mixture of a customary middle distillate of fossil origin and a biofuel oil which is based on fatty acid esters. Component (c) is not absolutely necessary to achieve the intended flowability improvement, but usually enhances this action considerably.

The polar oil-soluble nitrogen compounds of component (a), which are capable of sufficiently dispersing paraffin crystals which have precipitated out under cold conditions in fuels, may be either of ionic or of nonionic nature and have preferably at least one substituent, in particular at least two substituents of the general formula $>NR^{22}$, where $R^{22}$ is a $C_8$- to $C_{40}$-hydrocarbon radical. The nitrogen substituents may also be quaternized, i.e. be present in cationic form. Examples of such nitrogen compounds are ammonium salts and/or amides which are obtainable by the reaction of at least one amine substituted by at least one hydrocarbon radical with a carboxylic acid having from 1 to 4 carboxyl groups or with a suitable derivative thereof. The amines preferably comprise at least one linear $C_8$- to $C_{40}$-alkyl radical. Suitable primary amines are, for example, octylamine, nonylamine, decylamine, undecylamine, dodecylamine, tetradecylamine, and the higher linear homologs. Suitable secondary amines are, for example, dioctadecylamine and methylbehenylamine. Also suitable are amine mixtures, especially amine mixtures obtainable on the industrial scale, such as fatty amines or hydrogenated tallamines, as described, for example, in Ullmanns Encyclopedia of Industrial Chemistry, 6th edition, in the chapter "Amines, aliphatic". Acids suitable for the reaction are, for example, cyclohexane-1,2-dicarboxylic acid, cyclohexene-1,2-dicarboxylic acid, cyclopentane-1,2-dicarboxylic acid, naphthalenedicarboxylic acid, phthalic acid, isophthalic acid, terephthalic acid and succinic acids substituted by long-chain hydrocarbon radicals.

Further examples of suitable polar oil-soluble nitrogen compounds are ring systems which bear at least two substituents of the formula $-A'-NR^{23}R^{24}$ where A' is a linear or branched aliphatic hydrocarbon group which is optionally interrupted by one or more moieties selected from O, S, $NR^{35}$ and CO, and $R^{23}$ and $R^{24}$ are each a $C_9$- to $C_{40}$-hydrocarbon radical which is optionally interrupted by one or more moieties selected from O, S, $NR^{35}$ and CO, and/or substituted by one or more substituents selected from OH, SH and $NR^{35}R^{36}$, where $R^{35}$ is $C_1$- to $C_{40}$-alkyl which is optionally interrupted by one or more moieties selected from CO, $NR^{35}$, O and S, and/or substituted by one or more radicals selected from $NR^{37}R^{38}$, $OR^{37}$, $SR^{37}$, $COR^{37}$, $COOR^{37}$, $CONR^{37}R^{38}$, aryl or heterocyclyl, where $R^{37}$ and $R^{38}$ are each independently selected from H and $C_1$- to $C_4$-alkyl and where $R^{36}$ is H or $R^{35}$.

In a preferred embodiment, the inventive mixture comprises as component (a), at least one oil-soluble reaction product formed from poly($C_2$- to $C_{20}$-carboxylic acids) having at least one tertiary amino group with primary or secondary amines.

The poly($C_2$- to $C_{20}$-carboxylic acids) which have at least one tertiary amino group and underlie the preferred component (a) comprise preferably at least 3 carboxyl groups, especially from 3 to 12 carboxyl groups, in particular from 3 to 5 carboxyl groups. The carboxylic acid units in the polycarboxylic acids have preferably from 2 to 10 carbon atoms; they are especially acetic acid units. The carboxylic acid units are joined in a suitable manner to the polycarboxylic acids, for example via one or more carbon and/or nitrogen atoms. They are preferably attached to tertiary nitrogen atoms which, in the case of a plurality of nitrogen atoms, are bonded via carbon chains.

In an even more preferred embodiment, the inventive mixture comprises, as component (a), at least one oil-soluble reaction product based on poly($C_2$- to $C_{20}$-carboxylic acids) which have at least one tertiary amino group and are of the general formula I or II

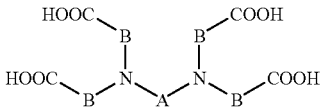

(I)

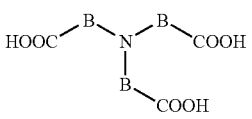

(II)

in which the variable A is a straight-chain or branched $C_2$- to $C_6$-alkylene group or is the moiety of the formula III

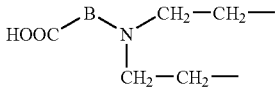

(III)

and the variable B is a $C_1$- to $C_{19}$-alkylene group.

Moreover, the preferred oil-soluble reaction product of component (a), especially that of the general formula I or II, is an amide, an amide ammonium salt or an ammonium salt, in which no, one or more carboxylic acid groups have been converted to amide groups.

Straight-chain or branched $C_2$- to $C_6$-alkylene groups of the variables A are, for example, 1,1-ethylene, 1,2-propylene, 1,3-propylene, 1,2-butylene, 1,3-butylene, 1,4-butylene, 2-methyl-1,3-propylene, 1,5-pentylene, 2-methyl-1,4-butylene, 2,2-dimethyl-1,3-propylene, 1,6-hexylene (hexamethylene) and in particular 1,2-ethylene. Variable A preferably comprises from 2 to 4, in particular 2 or 3 carbon atoms.

$C_1$- to $C_{19}$-alkylene groups of the variables B are, for example, 1,2-ethylene, 1,3-propylene, 1,4-butylene, hexamethylene, octamethylene, decamethylene, dodecamethylene, tetradecamethylene, hexadecamethylene, octadecamethylene, nonadecamethylene and in particular methylene. Variable B comprises preferably from 1 to 10, in particular from 1 to 4 carbon atoms.

The primary and secondary amines as a reactant for the polycarboxylic acids to form component (a) are typically monoamines, especially aliphatic monoamines. These primary and secondary amines may be selected from a multitude of amines which bear hydrocarbon radicals optionally joined to one another.

In a preferred embodiment, these amines underlying the oil-soluble reaction products of component (a) are secondary amines and have the general formula $HNR_2$ in which the two variables R are each independently straight-chain or branched $C_{10}$- to $C_{30}$-alkyl radicals, in particular $C_{14}$- to $C_{24}$-alkyl radicals. These relatively long-chain alkyl radicals are preferably straight-chain or branched only to a slight degree. In general, the secondary amines mentioned, with regard to their relatively long-chain alkyl radicals, derive from naturally occurring fatty acid or from derivatives thereof. The two R radicals are preferably identical.

The secondary amines mentioned may be bonded to the polycarboxylic acids by means of amide structures or in the form of the ammonium salts; it is also possible for only a portion to be present in the form of amide structures and another portion in the form of ammonium salts. Preferably only a few, if any, acid groups are present. In a preferred embodiment, the oil-soluble reaction products of component (a) are present fully in the form of the amide structures.

Typical examples for component (a) are reaction products of nitrilotriacetic acid, of ethylenediaminetetraacetic acid or of propylene-1,2-diaminetetraacetic acid with in each case from 0.5 to 1.5 mol per carboxyl group, in particular from 0.8 to 1.2 mol per carboxyl group, of dioleylamine, dipalmitamine, dicoconut fatty amine, distearylamine, dibehenylamine or in particular ditallow fatty amine. A particularly preferred component (a) is the reaction product formed from 1 mol of ethylenediaminetetraacetic acid and 4 mol of hydrogenated ditallow fatty amine.

Further typical examples of component (a) include the N,N-dialkylammonium salts of 2-N',N'-dialkylamidobenzoates, for example the reaction product formed from 1 mol of phthalic anhydride and 2 mol of ditallow fatty amine, the latter being hydrogenated or unhydrogenated, and the reaction product of 1 mol of an alkenyl-spiro-bislactone with 2 mol of a dialkylamine, for example ditallow fatty amine and/or tallow fatty amine, the latter two compounds being hydrogenated or unhydrogenated.

The polyamines underlying the oil-soluble acid amides of component (b) may either be structurally clearly defined low molecular weight "oligo" amines or polymers having up to 1000, especially up to 500, in particular up to 100 nitrogen atoms in the macromolecule. The latter are then typically polyalkyleneimines, for example polyethyleneimines, or polyvinylamines.

The polyamines mentioned are reacted with $C_8$- to $C_{30}$-fatty acids, especially $C_{16}$- to $C_{20}$-fatty acids, or fatty acid-like compounds comprising free carboxyl groups to give the oil-soluble acid amides. Instead of the free fatty acids, it is also possible in principle to use reactive fatty acid derivatives such as the corresponding esters, halides or anhydrides for the reaction.

The polyamines are reacted with the fatty acids to give the oil-soluble acid amides of component (b) fully or partially. In the latter case, usually minor proportions of the product are present, typically in the form of corresponding ammonium salts. The completeness of the conversion to the acid amides can, however, generally be controlled by the reaction parameters. The preparation of the acid amides of component (b) is described in document (2).

Examples of polyamines suitable for the reaction to give the acid amides of component (b) include: ethylenediamine, diethylenetriamine, triethylenetetramine, tetraethylenepentamine, pentaethylenehexamine, dipropylenetriamine, tripropylenetetramine, tetrapropylenepentamine, pentapropylenehexamine, polyethyleneimines of a mean degree of polymerization (corresponding to the number of nitrogen atoms) of, for example, 10, 35, 50 or 100, and also polyamines which have been obtained by reacting oligoamines (with chain extension) with acrylonitrile and subsequent hydrogenation, for example N,N'-bis-(3-aminopropyl)ethylenediamine.

Suitable fatty acids for the reaction to give the acid amides of component (b) include pure fatty acids and also industrially customary fatty acid mixtures which comprise, for example, stearic acid, palmitic acid, lauric acid, oleic acid, linolic acid and/or linolenic acid. Of particular interest here are naturally occurring fatty acid mixtures, for example tallow fatty acid, coconut oil fatty acid, fish oil fatty acid, coconut palm kernel oil fatty acid, soybean oil fatty acid, colza oil fatty acid, peanut oil fatty acid or palm oil fatty acid, which comprise oleic acid and palmitic acid as mean components.

Examples of fatty acid-like compounds which comprise free carboxyl groups and are likewise suitable for reaction with the polyamines mentioned to give the acid amides of component (b) are monoesters of long-chain alcohols of dicarboxylic acids, such as tallow fatty alcohol maleic acid monoesters or tallow fatty alcohol succinic acid monoesters, or corresponding glutaric acid monoesters or adipic acid monoesters.

In a preferred embodiment, the inventive mixture comprises, as component (b), at least one oil-soluble acid amide formed from aliphatic polyamines having from 2 to 6 nitrogen atoms and $C_{16}$- to $C_{20}$-fatty acids, all primary and secondary amino functions of the polyamines having been converted to acid amide functions.

A typical example of an oil-soluble acid amide of component (b) is the reaction product of 3 mol of oleic acid with 1 mol of diethylenetriamine.

The α,β-dicarboxylic acids which underlie the oil-soluble reaction products of component (c) and have from 4 to 300, especially from 4 to 75, in particular from 4 to 12 carbon atoms are typically succinic acid, maleic acid, fumaric acid or derivatives thereof, which may have, on the bridging ethylene or ethenylene group, relatively short- or long-chain hydrocarbyl substituents which may comprise or bear heteroatoms and/or functional groups. For the reaction with the primary alkylamines, these are generally used in the form of the free dicarboxylic acid or reactive derivatives thereof. The reactive derivatives used here may be carbonyl halides, carboxylic esters or in particular carboxylic anhydrides.

In a preferred embodiment, the inventive mixture comprises, as component (c), at least one oil-soluble reaction product formed from maleic anhydride and primary alkylamines.

The primary alkylamines underlying the oil-soluble reaction products of component (c) are typically mid-chain or long-chain alkylmonoamines having preferably from 8 to 30, in particular from 12 to 22 carbon atoms, and linear or branched, saturated or unsaturated alkyl chain, for example octyl-, nonyl-, isononyl-, decyl-, undecyl-, tridecyl-, isotridecyl-, tetradecyl-, pentadecyl-, hexadecyl-, heptadecyl-, octadecylamine, and also mixtures of such amines. When naturally occurring fatty amines are to be used as such primary alkylamines, suitable alkylamines are in particular coconut amine, tallow fat amine, oleylamine, arachidylamine or behenylamine, and mixtures thereof. The reaction products of component (c) are typically, depending on the stoichiometry and reaction, present in the form of monoamides or bisamides of maleic acid; they may also comprise a minor amount of corresponding ammonium salts. The preparation of the oil-soluble reaction products of component (c) from maleic anhydride and primary alkyl amines is described in document (1).

A typical example of an oil-soluble reaction product of component (c) is the reaction product of 1 mol of maleic anhydride with 1 mol of isotridecylamine, which is present predominantly as the monoamide of maleic acid.

The inventive mixture can be prepared by simple mixing, if appropriate in a suitable solvent, of components (a) and (b) or (a) to (c) without supplying heat.

When component (c) is not used, the inventive mixture comprises components (a) and (b) preferably in the following ratios, the sum of these two components in each case adding up to 100% by weight:

(a) from 50 to 95% by weight, especially from 55 to 85% by weight, in particular from 60 to 70% by weight;
(b) from 5 to 50% by weight, especially from 15 to 45% by weight, in particular from 30 to 40% by weight.

When component (c) is used, the inventive mixture comprises components (a) to (c) preferably in the following ratios, the sum of all three components in each case adding up to 100% by weight:

(a) from 50 to 85% by weight, especially from 55 to 75% by weight, in particular from 60 to 70% by weight;
(b) from 10 to 40% by weight, especially from 15 to 35% by weight, in particular from 20 to 30% by weight;
(c) from 1 to 25% by weight, especially from 5 to 20% by weight, in particular from 10 to 20% by weight.

The inventive mixture is suitable as an additive to fuels, especially middle distillate fuels. Middle distillate fuels, which find use in particular as gas oils, petroleum, diesel oils (diesel fuels) or light heating oils, are often also referred to as fuel oils. Such middle distillate fuels generally have boiling points of from 150 to 400° C.

The inventive mixture can be added to the fuels directly, i.e. undiluted, but preferably as of from 10 to 70% by weight, especially as of from 30 to 65% by weight, in particular as of from 45 to 60% by weight solution (concentrate) in a suitable solvent, typically a hydrocarbon solvent. Such a concentrate, comprising from 10 to 70% by weight, especially from 30 to 65% by weight, in particular from 45 to 60% by weight, based on the total amount of the concentrate, of the inventive mixture, dissolved in a hydrocarbon solvent, therefore also forms part of the subject matter of the present invention. Common solvents in this context are aliphatic or aromatic hydrocarbons, for example xylenes or mixtures of high-boiling aromatics such as Solvent Naphtha. Middle distillate fuels themselves may also be used as the solvent for such concentrates.

The dosage of the mixture in the fuels is generally from 10 to 10 000 ppm by weight, especially from 50 to 5000 ppm by weight, in particular from 50 to 1000 ppm by weight, for example from 150 to 400 ppm by weight, based in each case on the total amount of middle distillate fuel.

In a preferred embodiment, the inventive mixture is used as an additive to fuels which consists (A) to an extent of from 0.1 to 75% by weight, preferably to an extent of from 0.5 to 50% by weight, especially to an extent of from 1 to 25% by weight, in particular to an extent of from 3 to 12% by weight, of at least one biofuel oil which is based on fatty acid esters, and (B) to an extent of from 25 to 99.9% by weight, preferably to an extent of from 50 to 99.5% by weight, especially to an extent of from 75 to 99% by weight, in particular to an extent of from 88 to 97% by weight, of middle distillates of fossil origin and/or of vegetable and/or animal origin, which are essentially hydrocarbon mixtures and are free of fatty acid esters.

The fuel component (A) is usually also referred to as "biodiesel". The middle distillates of the fuel component (A) are preferably essentially alkyl esters of fatty acids which derive from vegetable and/or animal oils and/or fats. Alkyl esters are typically understood to mean lower alkyl esters, especially $C_1$- to $C_4$-alkyl esters, which are obtainable by transesterifying the glycerides which occur in vegetable and/or animal oils and/or fats, especially triglycerides, by means of lower alcohols, for example ethanol, n-propanol, isopropanol, n-butanol, isobutanol, sec-butanol, tert-butanol or in particular methanol ("FAME").

Examples of vegetable oils which can be converted to corresponding alkyl esters and can thus serve as the basis of biodiesel are castor oil, olive oil, peanut oil, palm kernel oil, coconut oil, mustard oil, cottonseed oil and especially sunflower oil, palm oil, soybean oil and rapeseed oil. Further examples include oils which can be obtained from wheat, jute, sesame and shea tree nut; it is also possible to use arachis oil, jatropha oil and linseed oil. The extraction of these oils and their conversion to the alkyl esters are known from the prior art or can be derived therefrom.

It is also possible to convert already used vegetable oils, for example used deep fat fryer oil, if appropriate after appropriate cleaning, to alkyl esters and thus for them to serve as the basis for biodiesel.

Vegetable fats can in principle likewise be used as a source for biodiesel, but play a minor role.

Examples of animal fats and oils which are converted to corresponding alkyl esters and can thus serve as the basis of biodiesel are fish oil, bovine tallow, porcine tallow and similar fats and oils obtained as wastes in the slaughter or utilization of farm animals or wild animals.

The saturated or unsaturated fatty acids which underlie the vegetable and/or animal oils and/or fats mentioned, which usually have from 12 to 22 carbon atoms and may bear additional functional groups such as hydroxyl groups, and occur in the alkyl esters, are in particular lauric acid, myristic acid, palmitic acid, stearic acid, oleic acid, linolic acid, linolenic acid, elaidic acid, erucic acid and ricinolic acid, especially in the form of mixtures of such fatty acids.

Typical lower alkyl esters based on vegetable and/or animal oils and/or fats, which find use as biodiesel or biodiesel components, are, for example, sunflower methyl ester, palm oil methyl ester ("PME"), soybean oil methyl ester ("SME") and in particular rapeseed oil methyl ester ("RME").

However, it is also possible to use the monoglycerides, diglycerides and especially triglycerides themselves, for example caster oil, or mixtures of such glycerides, as biodiesel or components for biodiesel.

In the context of the present invention, the fuel component (B) shall be understood to mean middle distillate fuels boiling in the range from 120 to 450° C. Such middle distillate fuels are used in particular as diesel fuel, heating oil or kerosene, particular preference being given to diesel fuel and heating oil.

Middle distillate fuels refer to fuels which are obtained by distilling crude oil and boil within the range from 120 to 450° C. Preference is given to using low-sulfur middle distillates, i.e. those which comprise less than 350 ppm of sulfur, especially less than 200 ppm of sulfur, in particular less than 50 ppm of sulfur. In special cases, they comprise less than 10 ppm of sulfur; these middle distillates are also referred to as "sulfur-free". They are generally crude oil distillates which have been subjected to refining under hydrogenation, conditions and which therefore comprise only small proportions of polyaromatic and polar compounds. They are preferably those middle distillates which have 95% distillation points below 370° C., in particular below 350° C. and in special cases below 330° C.

Low-sulfur and sulfur-free middle distillates may be obtained from relatively heavy crude oil fractions which cannot be distilled under atmospheric pressure. Typical conversion processes for preparing middle distillates from heavy crude oil fractions include: hydrocracking, thermal cracking, catalytic cracking, coking, processes and/or visbreaking. Depending on the process, these middle distillates are obtained in low-sulfur or sulfur-free form, or are subjected to refining under hydrogenating conditions.

The middle distillates preferably have aromatics contents of below 28% by weight, especially below 20% by weight. The content of normal paraffins is between 5% by weight and 50% by weight, preferably between 10 and 35% by weight.

The middle distillates referred to as fuel component (B) shall also be understood here to mean middle distillates which can either be derived indirectly from fossil sources such as mineral oil or natural gas, or else can be prepared by biomass via gasification and subsequent hydrogenation. A typical example of a middle distillate fuel which is derived indirectly from fossil sources is the GTL ("gas-to-liquid") diesel fuel obtained by means of Fischer-Tropsch synthesis. A middle distillate is prepared from biomass, for example via the BTL ("bio-to-liquid") process, and can either be used alone or in a mixture with other middle distillates as fuel component (B). The middle distillates also include hydrocarbons which are obtained by hydrogenation of fats and fatty oils. They comprise predominantly n-paraffins. It is common to the middle distillate fuels mentioned that they are essentially hydrocarbon mixtures and are free of fatty acid esters.

The qualities of the heating oils and diesel fuels are laid down in more detail, for example, in DIN 51603 and EN 590 (cf. also Ullmann's Encyclopedia of Industrial Chemistry, 5th edition, volume A 12, p. 617 ff., which is hereby incorporated explicitly by reference).

The inventive mixture is used in the fuels mentioned preferably in the function as a paraffin dispersant ("WASA"). The inventive mixture displays its action as a paraffin dispersant particularly efficiently often only together with the customary flow improvers.

In the context of the present invention, flow improvers shall be understood to mean all additives which improve the cold properties of middle distillate fuels. In addition to the actual cold flow improvers ("MDFI"), these are also nucleators (cf. also Ullmann's Encyclopedia of Industrial Chemistry, 5th edition, volume A16, p. 719 ff.).

The inventive middle distillate fuels comprise, in addition to the inventive mixture, in the presence of cold flow improvers, the cold flow improvers in an amount of typically from 1 to 2000 ppm by weight, preferably from 5 to 1000 ppm by weight, especially from 10 to 750 ppm by weight and in particular from 50 to 500 ppm by weight, for example from 150 to 400 ppm by weight.

Useful such cold flow improvers include, especially for the combination with the inventive mixture, one or more of those mentioned below, which are customary representatives for use in middle distillate fuels:

(d) copolymers of ethylene with at least one further ethylenically unsaturated monomer;
(e) comb polymers;
(f) polyoxyalkylenes;
(g) sulfocarboxylic acids or sulfonic acids or derivatives thereof;
(h) poly(meth)acrylic esters.

In the copolymers of ethylene with at least one further ethylenically unsaturated monomer of group (d), the monomer is preferably selected from alkenylcarboxylic esters, (meth)acrylic esters and olefins.

Suitable olefins are, for example, those having from 3 to 10 carbon atoms and having from 1 to 3, preferably having 1 or 2, especially having one carbon-carbon double bond. In the latter case, the carbon-carbon double bond may be arranged either terminally α-olefins) or internally. However, preference is given to α-olefins, particular preference to α-olefins having from 3 to 6 carbon atoms, for example propene, 1-butene, 1-pentene and 1-hexene.

Suitable (meth)acrylic esters are, for example, esters of (meth)acrylic acid with $C_1$- to $C_{10}$-alkanols, especially with methanol, ethanol, propanol, isopropanol, n-butanol, sec-butanol, isobutanol, tert-butanol, pentanol, hexanol, heptanol, octanol, 2-ethylhexanol, nonanol and decanol.

Suitable alkenylcarboxylic esters are, for example, the vinyl and propenyl esters of carboxylic acids having from 2 to 20 carbon atoms, whose hydrogen radical may be linear or branched. Among these, preference is given to the vinyl esters. Among the carboxylic acids having a branched hydrocarbon radical, preference is given to those whose branch is in the α-position to the carboxyl group, the α-carbon atom more preferably being tertiary, i.e. the carboxylic acid being a so-called neocarboxylic acid. However, the hydrocarbon radical of the carboxylic acid is preferably linear.

Examples of suitable alkenylcarboxylic esters are vinyl acetate, vinyl propionate, vinyl butyrate, vinyl 2-ethylhexanoate, vinyl neopentanoate, vinyl hexanoate, vinyl neononanoate, vinyl neodecanoate, and the corresponding propenyl esters, preference being given to the vinyl esters. A particularly preferred alkenylcarboxylic ester is vinyl acetate; typical copolymers of group (d) resulting therefrom are ethylene-vinyl acetate copolymers ("EVA"), which are used to a large extent in diesel fuels.

The ethylenically unsaturated monomer is more preferably selected from alkenylcarboxylic esters.

Also suitable are copolymers which comprise, in copolymerized form, two or more different alkenylcarboxylic esters, which preferably differ in the alkenyl function and/or in the carboxylic acid group. Likewise suitable are copolymers which, in addition to the alkenylcarboxylic ester(s), comprise, in copolymerized form, at least one olefin and/or at least one (meth)acrylic ester.

The ethylenically unsaturated monomer is copolymerized in the copolymer of group (d) in an amount of preferably from 1 to 50 mol %, especially from 10 to 50 mol % and in particular from 5 to 20 mol %, based on the overall copolymer.

The copolymer of group (d) preferably has a number-average molecular weight $M_n$ of from 1000 to 20 000, more preferably from 1000 to 10 000 and especially preferably from 1000 to 6000.

Comb polymers of group (e) are, for example, those described in "Comb-Like Polymers, Structure and Properties", N. A. Platé and V. P. Shibaev, J. Poly. Sci. Macromolecular Revs. 8, pages 117 to 253 (1974). Among those described there, suitable comb polymers are, for example, those of the formula IV (IV)

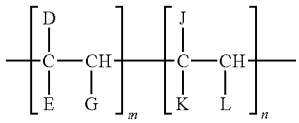

in which

D is $R^{17}$, $COOR^{17}$, $OCOR^{17}$, $R^{18}$, $OCOR^{17}$ or $OR^{17}$,
E is H, $CH_3$, D or $R^{18}$,
G is H or D,
J is H, $R^{18}$, $R^{18}COOR^{17}$, aryl or heterocyclyl,
K is H, $COOR^{18}$, $OCOR^{8}$, $OR^{18}$ or COOH,
L is H, $R^{8}$, $COOR^{8}$, $OCOR^{8}$, COOH or aryl,
where
$R^{17}$ is a hydrocarbon radical having at least 10 carbon atoms, preferably having from 10 to 30 carbon atoms,
$R^{18}$ is a hydrocarbon radical having at least one carbon atom, preferably having from 1 to 30 carbon atoms,
m is a molar fraction in the range from 1.0 to 0.4 and
n is a molar fraction in the range from 0 to 0.6.

Preferred comb polymers are obtainable, for example, by copolymerization of maleic anhydride or fumaric acid with another ethylenically unsaturated monomer, for example with an α-olefin or an unsaturated ester, such as vinyl acetate, and subsequent esterification of the anhydride or acid function with an alcohol having at least 10 carbon atoms. Further preferred comb polymers are copolymers of α-olefins and esterified comonomers, for example esterified copolymers of styrene and maleic anhydride or esterified copolymers of styrene and fumaric acid. Also suitable are mixtures of comb polymers. Comb polymers may also be polyfumarates or polymaleates. Homo- and copolymers of vinyl ethers are also suitable comb polymers.

Suitable polyoxyalkylenes of group (f) are, for example polyoxyalkylene esters, ethers, ester/ethers and mixtures thereof. The polyoxyalkylene compounds preferably comprise at least one, more preferably at least two, linear alkyl group(s) having from 10 to 30 carbon atoms and a polyoxyalkylene group having a molecular weight of up to 5000. The alkyl group of the polyoxyalkylene radical preferably comprises from 1 to 4 carbon atoms. Such polyoxyalkylene compounds are described, for example, in EP-A-061 895 and in U.S. Pat. No. 4,491,455, which are hereby fully incorporated by reference. Preferred polyoxyalkylene esters, ethers and ester/ethers have the general formula V $$R^{19}[—O—(CH_2)_y]_xO—R^{20} \quad (V)$$

in which $R^{19}$ and $R^{20}$ are each independently $R^{21}$, $R^{21}$—CO—, $R^{21}$—O—CO$(CH_2)_z$— or $R^{21}$—O—CO$(CH_2)_z$—CO—, where $R^{21}$ is linear $C_1$-$C_{30}$-alkyl, y is from 1 to 4, x is from 2 to 200, and z is from 1 to 4.

Preferred polyoxyalkylene compounds of the formula V in which both $R^{19}$ and $R^{20}$ are $R^{21}$ are polyethylene glycols and polypropylene glycols having a number-average molecular weight of from 100 to 5000. Preferred polyoxyalkylenes of the formula III in which one of the $R^{19}$ radicals is $R^{21}$ and the other is $R^{21}$—CO— are polyoxyalkylene esters of fatty acids having from 10 to 30 carbon atoms, such as stearic acid or behenic acid. Preferred polyoxyalkylene compounds in which both $R^{19}$ and $R^{20}$ are an $R^{21}$—CO— radical are diesters of fatty acids having from 10 to 30 carbon atoms, preferably of stearic acid or behenic acid.

Suitable sulfocarboxylic acids/sulfonic acids or their derivatives of group (g) are, for example, those of the general formula VI

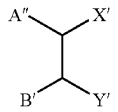

(VI)

in which

Y' is $SO_3^-(NR^{25}{}_3R^{26})^+$, $SO_3^-(NHR^{25}{}_2R^{26})^+$, $SO_3^-(NH_2R^{25}R^{26})$, $SO_{3-}(NH_3R^{26})$ or $SO_2NR^{25}R^{26}$,

X' is Y', $CONR^{25}R^{27}$, $CO_2^-(NR^{25}{}_3R^{27})^+$, $CO_2$—$(NHR^{25}{}_2R^{27})^+$, $R^{28}$—$COOR^{27}$, $NR^{25}COR^{27}$, $R^{28}OR^{27}$, $R^{28}OCOR^{27}$, $R^{28}R^{27}$, $N(COR^{25})R^{27}$ or $Z^{-(NR25}{}_3R^{27})^+$, where $R^{25}$ is a hydrocarbon radical, $R^{26}$ and $R^{27}$ are each alkyl, alkoxyalkyl or polyalkoxyalkyl having at least 10 carbon atoms in the main chain, $R^{28}$ is $C_2$-$C_5$-alkylene, $Z^-$ is one anion equivalent and A" and B' are each alkyl, alkenyl or two substituted hydrocarbon radicals or, together with the carbon atoms to which they are bonded, form an aromatic or cycloaliphatic ring system.

Such sulfo carboxylic acids and sulfonic acids and their derivatives are described in EP-A-0 261 957, which is hereby fully incorporated by reference.

Suitable poly(meth)acrylic esters of group (h) are either homo- or copolymers of acrylic and methacrylic esters. Preference is given to copolymers of at least two different (meth) acrylic esters which differ in the esterified alcohol. If appropriate, the copolymer comprises a further, different copolymerized olefinically unsaturated monomer. The weight-average molecular weight of the polymer is preferably from 50 000 to 500 000. A particularly preferred polymer is a copolymer of methacrylic acid and methacrylic esters of saturated $C_{14}$- and $C_{15}$-alcohols, in which the acid groups have been neutralized with hydrogenated tallamine. Suitable poly(meth)acrylic esters are described, for example, in WO 00/44857, which is hereby fully incorporated by way of reference.

With customary flow improvers, for example ethylene-vinyl acetate copolymers from group (d), as described in WO 99/29748 (4), or comb polymers from group (e), as described in WO 2004/035715 (5), the inventive mixture, in its function as a paraffin dispersant, forms an efficient and versatile cold stabilization system for middle distillate fuels, especially for those having a content of biodiesel.

It is equally possible to improve a series of further fuel properties by the use of the inventive mixture. The only examples mentioned here shall be the additional action as a corrosion protectant or the improvement in the oxidation stability.

In the case of use in low-sulfur fuels which comprise predominantly or solely component (B), the use of the inventive mixture, especially in combination with flow improvers, can contribute to an improvement in the lubricity. The lubricity is determined, for example, in the so-called HFRR test to ISO 12156.

The inventive mixture may be added either to middle distillate fuels which are entirely of fossil origin, i.e. have been obtained from crude oil, or fuels which, in addition to the proportion based on crude oil, comprise a proportion of biodiesel, to improve their properties. In both cases, a significant improvement in the cold flow behavior of the middle distillate fuel, i.e. a lowering of the CP values and/or CFPP values, is observed irrespective of the origin or of the composition of the fuel. The precipitated paraffin crystals are kept suspended effectively, so that there are no blockages of filters and lines by sedimented paraffin. The inventive mixture has a good activity spectrum and thus has the effect that the precipitated paraffin crystals are dispersed very efficiently in a wide variety of different middle distillate fuels.

The present invention also provides fuels, especially those having a biodiesel content, which comprise the inventive mixture.

In general, the fuels mentioned and the fuel additive concentrates mentioned also comprise, as further additives in amounts customary therefor, flow improvers (as described above), further paraffin dispersants, conductivity improvers, corrosion protection additives, lubricity additives, antioxidants, metal deactivators, antifoams, demulsifiers, detergents, cetane number improvers, solvents or diluents, dyes or fragrances or mixtures thereof. The aforementioned further additives which have not yet been addressed above are familiar to the person skilled in the art and therefore need not be illustrated further here.

The examples which follow are intended to illustrate the invention without restricting it.

EXAMPLES

Additive Components Used:

Component (a): ethylenediaminetetraacetic acid reacted with 4 mol of hydrogenated ditallow fatty amine, prepared in Solvent Naphtha as described in example 1 of document (1);

Component (b): diethylenetriamine reacted with 3 mol of oleic acid, prepared as described in example A 69 of table 1 of document (2);

Component (c): maleic anhydride reacted with 1 mol of tridecylamine, prepared in Solvent Naphtha as described in example 2 of document (1).

From the abovementioned components (a) to (c), the following concentrates C1 (inventive), C2 (for comparison) and C3 (for comparison) were prepared:

TABLE 1

| | C1 | C2 (for comparison) | C3 (for comparison) |
|---|---|---|---|
| Component (a) | 63 | 83 | — |
| Component (b) | 22 | — | 100 |
| Component (c) | 15 | 17 | — |

The mixing ratios reported in table 1 are percent by weight; the solvent content of these mixtures was 40% by weight; in addition, these mixtures also comprised 5% of customary additives which do not influence the cold flow-improving action.

The German winter diesel fuels (DF1 to DF7) mentioned are characterized by the following parameters:

DF1: CP (to ISO 3015): −.5.9° C., CFPP (to EN 116): −9° C.;
Density $d_{15}$ (DIN 51577): 837.5 kg/m$^3$;
Initial boiling point (DIN 51751): 178° C., final boiling point: 364° C.;
Paraffin content (by GC): 16.6% by weight DF2: CP (to ISO 3015): −5.9° C., CFPP (to EN 116): −7° C.;
Initial boiling point (DIN 51751): 180° C., final boiling point: 362° C.;
Paraffin content (by GC): 16.6% by weight DF3: CP (to ISO 3015): −7.0° C., CFPP (to EN 116): −8° C.;
Density $d_{15}$ (DIN 51577): 831.6 kg/m$^3$;
Initial boiling point (DIN 51751): 170° C., final boiling point: 357° C.;
Paraffin content (by GC): 22.1% by weight DF4: CP (to ISO 3015): −7.0° C., CFPP (to EN 116): −9° C.;
Initial boiling point (DIN 51751): 172° C., final boiling point: 355° C.;
Paraffin content (by GC): 22.2% by weight DF5: CP (to ISO 3015): −7.0° C., CFPP (to EN 116): −9° C.;
Density $d_{15}$ (DIN 51577): 828.9 kg/m$^3$;
Initial boiling point (DIN 51751): 176° C., final boiling point: 356° C.;
Paraffin content (by GC): 22.1% by weight DF6: CP (to ISO 3015): −7.40° C., CFPP (to EN 116): −7° C.;
Density $d_{15}$ (DIN 51577): 827.8 kg/m$^3$;
Initial boiling point (DIN 51751): 169° C., final boiling point: 349° C.;
Paraffin content (by GC): 21.8% by weight DF7: CP (to ISO 3015): −6.5° C., CFPP (to EN 116): −8° C.;
Density $d_{15}$ (DIN 51577): 824.1 kg/m$^3$;
Initial boiling point (DIN 51751): 182° C., final boiling point: 350° C.;
Paraffin content (by GC): 23.3% by weight The biodiesel additives used were: rapeseed oil methyl ester ("RME"), soybean oil methyl ester ("SME") or palm oil methyl ester ("PME").

The cold flow improvers ("MDFI") used were:

FB1: commercial ethylene-vinyl acetate copolymer having a vinyl acetate content of 30% by weight according to document (4);

FB2: Mixture according to document (5) of a commercial ethylene-vinyl acetate copolymer and a hydrocarbyl vinyl ether homopolymer with comb structure.

FB1 and FB2 were selected on the basis of their CFPP performance in the diesel fuels used. It is very likely that other diesel fuels require other MDFIs. In this respect, the inventive mixtures are not restricted to the use in conjunction with FB1 and FB2. In the experimental procedure described below, the additives C1 to C3 and FB1 or FB2 were each added separately to the diesel fuels. It is also possible to mix the concentrates C1, C2 and C3 first with the MDFI FB1 or FB2 and then to mix them together into the diesel fuels DF1 to DF7.

Description of the Test Method:

The fuels DF1 to DF7 were admixed with the amounts of biodiesel additive, the concentrate C1, C2 or C3 and the flow improver FB1 or FB2 specified in the table below, mixed with stirring at 40° C. and then cooled to room temperature. The CP to ISO 3015 and the CFPP to EN 116 of these additized fuel samples were determined. Thereafter, the additized fuel samples were cooled in 500 ml glass cylinders in a cold bath from room temperature at a cooling rate of approx. 14° C. per hour to −13° C., and stored at this temperature for 16 hours. Again, the CP to ISO 3015 and the CFPP to EN 116 of the 20% by volume bottom phase removed from each sample at −13° C. were determined. The smaller the deviation of the CP of the 20% by volume bottom phase from the original CP of the particular fuel sample, the better the dispersion of the paraffins.

The results obtained are listed in table 2 below.

TABLE 2

| Column | | | | | | | | | | | | |
|---|---|---|---|---|---|---|---|---|---|---|---|---|
| 1 Exp. No. | 2 DF | 3 Bio-diesel | 4 MDFI | 5 ppm | 6 WASA | 7 ppm | 8 CP* | 9 CP# | 10 Delta-CP | 11 CFPP* | 12 CFPP# | 13 % Sediment |
| 1-1 | DF6 | 5% RME | FB2 | 150 | C2 | 150 | −7.4 | +1.4 | 8.8 | −19 | −9 | 66 |
| 1-2 | | | | | C1 | 150 | −7.4 | −4.4 | 3.0 | −19 | −18 | 99 |
| 2-1 | DF4 | 5% RME | FB2 | 150 | C2 | 150 | −7.0 | +1.7 | 8.7 | −23 | −10 | 24 |
| 2-2 | | | | | C1 | 150 | −7.0 | −4.8 | 2.2 | −28 | −26 | 2 |
| 3-1 | DF7 | 5% RME | FP2 | 300 | C2 | 250 | −6.5 | −0.6 | 5.9 | −26 | −14 | 74 |
| 3-2 | | | | | C1 | 250 | −6.5 | −5.4 | 1.1 | −29 | −28 | 96 |
| 4-1 | DF5 | 5% RME | FB2 | 300 | C2 | 250 | −6.7 | −1.0 | 5.7 | −23 | −15 | 32 |
| 4-2 | | | | | C1 | 250 | −6.7 | −5.9 | 0.8 | −28 | −28 | 0 |
| 5-1 | DF3 | 10% RME | FB2 | 150 | C2 | 150 | −7.0 | −4.1 | 2.9 | −30 | −20 | 2 |
| 5-2 | | | | | C1 | 150 | −7.0 | −4.6 | 2.4 | −29 | −26 | 2 |
| 6-1 | DF3 | 5% SME | FB2 | 150 | C2 | 150 | −7.0 | −4.4 | 2.6 | −21 | −20 | 4 |
| 6-2 | | | | | C1 | 150 | −7.0 | −5.1 | 1.9 | −22 | −21 | 2 |
| 7-1 | DF3 | 5% PME | FB2 | 400 | C2 | 400 | −6.1 | −2.9 | 3.2 | −20 | −19 | 26 |
| 7-2 | | | | | C1 | 400 | −6.1 | −5.0 | 1.1 | −26 | −20 | 8 |
| 8-1 | DF1 | none | FB1 | 200 | C2 | 150 | −5.9 | −4.8 | 1.1 | −28 | −28 | 6 |
| 8-2 | | | | | C1 | 150 | −5.9 | −4.9 | 1.0 | −29 | −29 | 6 |
| 8-3 | DF2 | 5% RME | FB1 | 200 | C2 | 150 | −6.1 | +0.3 | 6.4 | −30 | −16 | 26 |

TABLE 2-continued

| Column | | | | | | | | | | | | |
|---|---|---|---|---|---|---|---|---|---|---|---|---|
| 1 Exp. No. | 2 DF | 3 Bio-diesel | 4 MDFI | 5 ppm | 6 WASA | 7 ppm | 8 CP* | 9 CP# | 10 Delta-CP | 11 CFPP* | 12 CFPP# | 13 % Sediment |
| 8-4 | | | | | C1 | 150 | −6.1 | −3.4 | 2.7 | −29 | −27 | 2 |
| 9-1 | DF3 | none | FB2 | 150 | C2 | 150 | −7.0 | −5.9 | 1.1 | −28 | −27 | 4 |
| 9-2 | | | | | C3 | 150 | −7.0 | 3.5 | 10.5 | −17 | −6 | 24 |
| 9-3 | | | | | C1 | 150 | −7.0 | −5.6 | 1.4 | −28 | −20 | 2 |
| 9-4 | DF3 | 5% RME | FB2 | 150 | C2 | 150 | −7.0 | +1.7 | 8.7 | −23 | −10 | 24 |
| 9-5 | | | | | C3 | 150 | −7.0 | +1.4 | 8.4 | −16 | −9 | 36 |
| 9-6 | | | | | C1 | 150 | −7.0 | −4.8 | 2.2 | −28 | −26 | 2 |

Legend to Table 2:

Column 3 reports amount (in % by weight) and type of the biodiesel additive used.

Column 5 reports the dosage of the flow improver FB1 or FB2 ("MDFI") specified in the 4th column in ppm by weight.

Column 7 reports the dosage of the paraffin dispersant ("WASA") C1 (inventive) or C2 (for comparison) or C3 (for comparison) specified in the 6th column in ppm by weight.

CP* (column 8) and CFPP* (column 11) report the values for the additized fuel samples before cooling. CP# (column 9) and CFPP# (column 12) report the corresponding values of the 20% by volume bottom phase removed in each case after cooling. Column 10 is the absolute value of the difference of CP# from CP*.

Column 13 of Table 2 reports the % by volume of sediment of paraffin after storage in the cold bath at −13° C.

Very low values (less than 40 vol. %) in column 13 refer to the degree of paraffin sedimentation. Accordingly, the lower the value specified in column 13, the lower the degree of paraffin sedimentation and the better the paraffin dispersion performance. On the other hand, very high values (more than 60 vol. %) in column 13 refer to the degree of paraffin dispersion. Accordingly, the higher the value specified in column 13, the higher the degree of paraffin dispersion and the better the paraffin dispersion performance. It should be mentioned that the values referred to in column 13 of Table 2 represent a qualitative aspect of paraffin dispersion performance, whereas the values referred to in column 10 of Table 2 represent a quantitative aspect of paraffin dispersion performance. As evidenced in columns 10 and 13 of Table 2, the smaller the Delta-CP value in column 10, the lower the degree of paraffin sedimentation and/or the higher the degree of paraffin dispersion in column 13, the better the paraffin dispersion performance. What is critical is a paraffin sedimentation usually of from approx. 10 to 30% by volume, since the majority of the precipitated paraffin crystals is then present in the 20% by volume bottom phase, which is used to characterize the effectiveness of the additives as described.

From table 2, it is evident from the delta-CP values (column 10) that, in the case of fuel samples having a biodiesel content, a clear improvement in the dispersion performance is achieved with C1 in all cases in comparison to C2 or C3. The experiments of series 8 and 9 in table 2 show the surprising effect of the inventive mixture on the paraffin sedimentation of diesel fuel-biodiesel mixtures. In pure diesel fuel (pure fuel DF3), approximately equally good effects are achieved with C1 and C2, while C3 in newer, low-sulfur diesel fuels no longer has sufficient performance (experiment 9-2). As a result of addition of 5% by weight of RME—as, for example, in experiments 8-3/4 and 9-4/6—the effect worsens drastically when the comparative examples C2 are used, while the cold properties remain virtually unchanged when the inventive mixture is used.

However, for samples 9-1 to 9-3 with middle distillate fuel without biofuel addition (i.e. a pure fuel sample based on crude oil) too, a slight improvement in the dispersion performance is observed with C1 compared to C2 and C3, recognizable by the low sediment value with approximately equal CP and CFPP values.

The invention claimed is:

1. A mixture comprising:

(a) 5-95 wt. % of at least one polar oil-soluble nitrogen compound other than components (b) and (c) which is capable of sufficiently dispersing paraffin crystals precipitated out under cold conditions in a fuel and is a reaction product formed from reacting a poly($C_2$- to $C_{20}$-carboxylic acid), which has at least one tertiary amino group, with a primary or secondary amine;

(b) 15-50 wt. % of at least one oil-soluble acid amide reaction product formed from reacting a polyamine, which has from 2 to 1000 carbon atoms, with a $C_8$- to $C_{30}$-fatty acid or fatty acid-like compound, which has a free carboxyl group; and (c) 1-50 wt. % of at least one oil-soluble reaction product formed from reacting an α,β-dicarboxylic acid, which has from 4 to 300 carbon atoms, or a derivative thereof, with a primary alkylamine, wherein the sum of all components of the mixture (a) to (c) add up to 100 wt. %.

2. The mixture according to claim 1, comprising, as component (a), at least one oil-soluble reaction product based on poly($C_2$- to $C_{20}$-carboxylic acids) which have at least one tertiary amino group and are of formula I or II

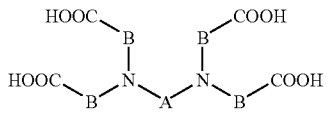

(I)

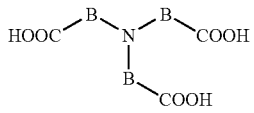

(II)

in which the variable A is a straight-chain or branched $C_2$- to $C_6$-alkylene group or is the moiety of formula III

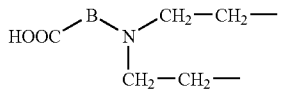

(III)

and the variable B is a $C_1$- to $C_{19}$-alkylene group.

3. The mixture according to claim 1, wherein the oil-soluble reaction product of component (a) is an amide, an amide ammonia salt or an ammonia salt, in which no, one or more carboxylic acid groups has/have been converted to amide groups.

4. The mixture according to claim 1, wherein the parent amines of the oil-soluble reaction products of component (a) are secondary amines and have a formula $HNR_2$ in which the two variables R are each independently straight-chain or branched $C_{10}$- to $C_{30}$-alkyl radicals.

5. The mixture according to claim 1, comprising, as component (b), at least one oil-soluble acid amide formed from aliphatic polyamines having from 2 to 6 nitrogen atoms and $C_{16}$- to $C_{20}$-fatty acids, wherein all primary and secondary amino functions of the polyamines are converted to acid amide functions.

6. The mixture according to claim 1, comprising, as component (c), at least one oil-soluble reaction product formed from maleic anhydride and primary alkylamines.

7. A fuel, comprising (A) from 0.1 to 75% by weight of at least one biofuel oil which is based on fatty acid esters, (B) from 25 to 99.9% by weight of middle distillates of fossil origin and/or of vegetable and/or animal origin, which are essentially hydrocarbon mixtures and are free of fatty acid esters, and (C) the mixture according to claim 1.

8. The fuel according to claim 7, further comprising one or more additives selected from the group consisting of flow improvers, further paraffin dispersants, conductivity improvers, corrosion protection additives, lubricity additives, antioxidants, metal deactivators, antifoams, demulsifiers, detergents, cetane number improvers, solvents, diluents, dyes, and fragrances.

9. A fuel additive concentrate comprising from 10 to 70% by weight, based on the total amount of the concentrate, of a mixture according to claim 1, dissolved in a hydrocarbon solvent.

10. The fuel additive concentrate according to claim 9, further comprising one or more additives selected from the group consisting of flow improvers, further paraffin dispersants, conductivity improvers, corrosion protection additives, lubricity additives, antioxidants, metal deactivators, antifoams, demulsifiers, detergents, cetane number improvers, solvents, diluents, dyes, and fragrances.

11. The mixture according to claim 1, wherein the at least one oil-soluble acid amide reaction product (b) is present in an amount of 20-50 wt. %, based on a total weight of the mixture.

12. The mixture according to claim 1, wherein the at least one oil-soluble acid amide reaction product (b) is present in an amount of 30-50 wt. %, based on a total weight of the mixture.

13. The mixture according to claim 1, wherein the at least one oil-soluble acid amide reaction product (b) is present in an amount of 35-50 wt. %, based on a total weight of the mixture.

14. The mixture according to claim 1, wherein the at least one oil-soluble acid amide reaction product (b) is present in an amount of 40-50 wt. %, based on a total weight of the mixture.

15. The mixture according to claim 1, wherein the at least one oil-soluble acid amide reaction product (b) is present in an amount of 45-50 wt. %, based on a total weight of the mixture.

16. The mixture according to claim 1, wherein the at least one oil-soluble acid amide reaction product (b) is present in an amount of 15-45 wt. %, based on a total weight of the mixture.

17. The mixture according to claim 1, wherein the at least one oil-soluble acid amide reaction product (b) is present in an amount of 15-35 wt. %, based on a total weight of the mixture.

18. The mixture according to claim 1, wherein the at least one oil-soluble acid amide reaction product (b) is present in an amount of 15-25 wt. %, based on a total weight of the mixture.

19. The mixture according to claim 1, wherein the at least one oil-soluble acid amide reaction product (b) is present in an amount of 20-30 wt. %, based on a total weight of the mixture.

20. The mixture according to claim 1, wherein the at least one oil-soluble acid amide reaction product (b) is present in an amount of 30-40 wt. %, based on a total weight of the mixture.

* * * * *